United States Patent [19]

Fushida et al.

[11] Patent Number: 4,477,551

[45] **Date of Patent: * Oct. 16, 1984**

[54] PHOTOSENSITIVE LAYER FOR ELECTROPHOTOGRAPHY

[75] Inventors: Akira Fushida, Suita; Yoshiaki Kato, Hirakata; Yasushi Kamezaki, Sakai, all of Japan

[73] Assignee: MHA Industrial Co., Ltd., Osaka, Japan

[ * ] Notice: The portion of the term of this patent subsequent to Jun. 14, 2000 has been disclaimed.

[21] Appl. No.: 495,925

[22] Filed: May 23, 1983

Related U.S. Application Data

[62] Division of Ser. No. 252,161, Apr. 8, 1981, abandoned.

[30] Foreign Application Priority Data

Apr. 10, 1980 [JP] Japan ..... 55-46268

[51] Int. Cl.[3] ..... G03G 5/07

[52] U.S. Cl. ..... 430/133; 430/134

[58] Field of Search ..... 730/71, 81, 82, 83, 730/127, 133, 134

[56] References Cited

U.S. PATENT DOCUMENTS

| | | | |
|---|---|---|---|
| 3,037,861 | 6/1962 | Hoegl et al. | 430/80 |
| 3,307,940 | 3/1967 | Hoegl et al. | 430/71 |
| 3,421,891 | 1/1969 | Inami et al. | 430/82 |
| 3,811,879 | 5/1974 | Montillier | 430/81 |
| 3,953,207 | 4/1976 | Horgan | 430/58 |
| 4,175,961 | 11/1979 | Wright et al. | 430/58 |
| 4,282,298 | 8/1981 | Smith et al. | 430/58 |
| 4,302,521 | 11/1981 | Takei et al. | 430/58 |
| 4,388,392 | 6/1983 | Kato et al. | 430/58 |

*Primary Examiner*—John E. Kittle
*Assistant Examiner*—John L. Goodrow
*Attorney, Agent, or Firm*—Sherman & Shalloway

[57] ABSTRACT

Disclosed is a photosensitive plate for electrophotography comprising a photosensitive layer containing a polyvinyl carbazole type photoconductor, wherein a fused tricyclic, tetracyclic or pentacyclic aromatic hydrocarbon, especially a fused tricyclic or tetracyclic aromatic hydrocarbon, is incorporated into the photosensitive layer in an amount of 0.05 to 3 parts by weight per part by weight of the polyvinyl carbazole type photoconductor in the photosensitive layer.

By incorporation of this fused aromatic hydrocarbon, the mechanical properties of the photosensitive layer, such as abrasion resistance, toughness and adhesion, are highly improved without bad influences on the sensitivity and other electrophotographic properties.

12 Claims, No Drawings

PHOTOSENSITIVE LAYER FOR ELECTROPHOTOGRAPHY

This application is a division of application Ser. No. 252,161, filed Apr. 8, 1981.

BACKGROUND OF THE INVENTION (1) Field of the Invention:

The present invention relates to an improvement in the photosensitive layer for electrophotography. More particularly, the present invention relates to a photosensitive layer containing a polyvinyl carbazole type photoconductor in which mechanical properties such as abrasion resistance, toughness and adhesion are improved.

(2) Description of the Prior Art:

Polyvinyl carbazole (often referred to as "PVK" hereinafter) is widely used as a polymeric photoconductor having film-forming and bonding properties for the manufacture of photosensitive materials for electrophotography. However, PVK is defective in that the toughness and adhesion are insufficient. For example, PVK is brittle, readily wears away while used for a long time and is apt to separate from a substrate in the form of slices.

As means for overcoming these defects of PVK, there is ordinarily adopted a method in which a polymeric binder such as a polyester resin, an epoxy resin or a polycarbonate resin is incorporated into PVK. However, these polymeric binders have no photoconductivity at all, and if such non-photoconductive binder is incorporated, a disadvantage of reduction of the sensitivity of the obtained photosensitive layer cannot be avoided. Furthermore, these polymeric binders are ordinarily poor in the compatibility with PVK, and therefore, a photosensitive layer comprising a blend of PVK and such polymeric binder is likely to have a heterogeneous structure and the resulting photosensitive layer is still insufficient in electrophotographic properties.

SUMMARY OF THE INVENTION

We found that when a fused tricyclic, tetracyclic or pentacyclic aromatic hydrocarbon, especially a fused tricyclic or tetracyclic aromatic hydrocarbon, is incorporated into a polyvinyl carbazole type photoconductor, mechanical properties such as abrasion resistance, toughness and adhesion can highly be improved in the resulting photosensitive layer without bad influences on the sensitivity and other electrophotographic properties.

More specifically, in accordance with the present invention, there is provided a photosensitive plate for electrophotography, which comprises a photosensitive layer containing a polyvinyl carbazole type photoconductor, wherein a fused tricyclic, tetracyclic or pentacyclic aromatic hydrocarbon, especially a fused tricyclic or tetracyclic aromatic hydrocarbon, is incorporated in a photosensitive layer in an amount of 0.05 to 3 parts by weight per part by weight of the polyvinyl carbazole type photoconductor in the photosensitive layer.

DETAILED DESCRIPTION OF THE PREFERRED EMBODIMENTS

As the polyvinyl carbazole type photoconductor that is used in the present invention, there can be mentioned, for example, above-mentioned PVK, poly-N-allylcarbazole, poly-N-propenylcarbazole, poly-N-(2-p-vinylbenzoylethyl)-carbazole, poly-N-acrylcarbazole, and nuclear substitution products thereof having such substituents as a nitro group, a halogen atom, a methyl group and an ethyl group. The molecular weight of the polyvinyl carbazole type photoconductor is not particularly critical, so far as it has a film-forming property.

By the term "fused tricyclic, tetracyclic or pentacyclic aromatic hydrocarbon" is meant an aromatic hydrocarbon in which 3, 4 or 5 rings are bonded through at least 2 covalent carbon atoms. The following compounds can be mentioned as preferred examples.

Fluorene having the following formula:

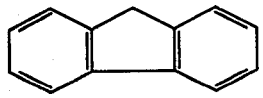

Phenanthrene having the following formula:

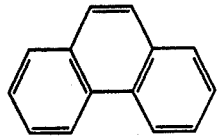

Acenaphthylene having the following formula:

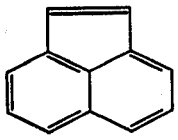

Pyrene having the following formula:

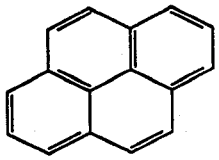

Furthermore, there can be used such aromatic compounds as perylene, dibenzophenanthrene, fluoranthene, aceanthrene, triphenylene, chrysene and benzopyrene.

It is preferred that the tricyclic, tetracyclic or pentacyclic aromatic hydrocarbon be present in the photosensitive layer in the state where the aromatic hydrocarbon and polyvinyl carbazole type photoconductor are dissolved in each other. From this viewpoint, it is preferred that the aromatic hydrocarbon be soluble in a solvent capable of dissolving the polyvinyl carbazole type photoconductor therein. The aromatic hydrocarbons exemplified above are very satisfactory also in this characteristic.

In the present invention, by incorporating the above-mentioned tricyclic, tetracyclic or pentacyclic aromatic hydrocarbon into the polyvinyl carbazole type photoconductor, mechanical properties such as abrasion resistance, toughness and adhesion can highly be improved without bad influences on the sensitivity and other photographic characteristics. As is illustrated in Examples given hereinafter, when a photosensitive plate having a photosensitive layer formed by coating of polyvinyl carbazole and a known binder is rubbed with high quality paper under a pressure of 2 $Kg/cm^2$, if rubbing is repeated only 10 times, the photosensitive layer is peeled on the entire surface and the substrate is exposed. In contrast, in case of a photosensitive plate having a photosensitive layer formed by incorporating the above-mentioned aromatic hydrocarbon into PVK according to the present invention, even if rubbing is carried out under the same conditions, peeling is not caused to occur at all or only very slight peeling occurs. Furthermore, the adhesion of the photosensitive layer is prominently improved according to the present invention. For example, when the above-mentioned conventional polyvinyl carbazole photosensitive layer is subjected to a peel adhesion test using a pressure-sensitive adhesive cellophane tape, the photosensitive layer is peeled substantially on the entire surface. On the other hand, it has been confirmed that in case of the photosensitive layer of the present invention, peeling does not occur at all at this peel adhesion test. Moreover, the photosensitive layer formed by incorporating the above-mentioned aromatic hydrocarbon into PVK according to the present invention has a slightly higher initial saturation surface voltage than that of the conventional photosensitive layer free of the aromatic hydrocarbon and has a sensitivity superior or comparable to that of the photosensitive layer free of the aromatic hydrocarbon.

The reason why such prominent improvements can be attained in the photosensitive layer of the present invention has not completely be elucidated. It is, however, considered that these prominent effects may be due to the fact that the above-mentioned tricyclic, tetracyclic, or pentacyclic aromatic hydrocarbon exerts a plasticizing action to the polyvinyl carbazole type photoconductor in the state where both the compounds are dissolved in each other and this aromatic hydrocarbon per se is an electron-donative photoconductive substance as well as polyvinyl carbazole.

In the present invention, it is important that the above-mentioned tricyclic, tetracyclic or pentacyclic aromatic hydrocarbon should be incorporated in an amount of 0.05 to 3 parts by weight, preferably 0.1 to 2 parts by weight, especially preferably 0.5 to 1.5 parts by weight, per part by weight of the polyvinyl carbazole type photoconductor. When the amount of the aromatic hydrocarbon is too small and below the above range, it becomes difficult or impossible to improve the above-mentioned mechanical properties, and when the amount of the aromatic hydrocarbon is too large and exceeds the above range, electrophotographic characteristics such as the photosensitivity tend to be degraded.

A layer formed of a composition comprising the above-mentioned aromatic hydrocarbon and polyvinyl carbazole type photoconductor in the state where they are dissolved in each other has a sensitivity to ultraviolet rays and near-ultraviolet rays. In order to impart a sensitivity to visible rays to this layer, a photoconductive pigment may be incorporated according to the known recipe, namely, in an amount of 5 to 300 parts by weight, especially 25 to 100 parts by weight, per 100 parts by weight of the polyvinyl carbazole type photoconductor.

As the photoconductive organic pigment, there can be mentioned, for example, a perylene type organic pigment, a bisazo pigment, a pyranthrone type pigment, a phthalocyanine pigment, a quinacridone type pigment, an indanthrene type pigment, an anthraquinone type pigment, a thioindigo type pigment and a perynone type pigment.

In order to improve the properties of the photosensitive layer of the present invention, known additives may be incorporated into the photosensitive layer according to known recipes.

It is known that sensitization can be accomplished by adding an electron-receptive substance such as trinitrofluorenone to polyvinyl carbazole to form a charge-transporting complex of both the compounds. Also in the photosensitive layer of the present invention, a chemical sensitizer formed of such electron-receptive substance may be incorporated in an amount of 1 to 200 parts by weight, especially 10 to 100 parts by weight, per 100 parts by weight of the polyvinyl carbazole type photoconductor. Preferred examples of the electron-receptive substance are disclosed in the specification of U.S. Pat. No. 3,287,120.

Furthermore, a polymeric binder having no photoconductivity, such as a polyester resin, an epoxy resin or a polycarbonate resin may be incorporated in an amount of up to 50 parts by weight per 100 parts by weight of the polyvinyl carbazole type photoconductor according to need, though incorporation of the polymeric binder is ordinarily unnecessary.

Moreover, in order to improve the surface smoothness of the photosensitive layer, a levelling agent such as polydimethylsiloxane may be used in an amount of 0.005 to 5 parts by weight per 100 parts by weight of the PVK type photoconductor.

The photosensitive layer of the present invention can easily be formed by dissolving the above-mentioned PVK type photoconductor and the tricyclic, tetracyclic or pentacyclic aromatic hydrocarbon into an organic solvent, dispersing the above-mentioned additives such as the photoconductive pigment into the solution according to need to form a coating composition, coating the composition on the surface of a conductive substrate and drying the coated composition.

As the solvent for dissolving both the PVK type photoconductor and aromatic hydrocarbon, there can be mentioned, for example, tetrahydrofuran (THF), chlorobenzene, methylene dichloride and a cyclohexane-toluene mixed solvent. An appropriate solvent is chosen and used according to the kinds of the PVK type photoconductor and aromatic hydrocarbon.

As the conductive substrate, there may be used a foil or plate of a metal such as aluminum, copper, tin or tinplate in the form of a sheet or drum. Furthermore, a laminate structure formed by depositing such metal on a substrate of a film such as a biaxially stretched film or a glass substrate by vacuum evaporation, sputtering or nonelectrode plating, or a Nesa glass, may be used as the conductive substrate.

It is preferred that the thickness of the photosensitive layer be 1 to 100 microns, especially 3 to 20 microns.

As is apparent from the foregoing description, the present invention is effective for improving mechanical properties of a single-layer photosensitive plate containing a PVK type photoconductor. It must be understood that these effects can similarly be attained also in a laminated photosensitive material including a layer containing a PVK type photoconductor.

The present invention will now be described in detail with reference to the following Examples that by no means limit the scope of the invention.

EXAMPLE 1

Standard Recipe (Free of Fused Aromatic Hydrocarbon)

| | |
|---|---|
| PVK (10% solution in THF) | 10 g |
| Permanent Red BL (Pigment Red 149 manufactured and supplied by Hoechst AG.) | 1 g |
| TSB 20 (10% polyester solution in THF manufacturcd and supplied by Toyobo K.K.) | 2 g |
| Tetrahydrofuran (THF) | 15 g |
| KF 96 (silicone oil having viscosity of 10 c.s., manufactured and supplied by Shinetsu Kagaku Kogyo K.K.) | 10 mg |

In the above-mentioned standard recipe, Permanent Red BL was dispersed in THF as the solvent for about 1 minute by an ultrasonic disperser, and the predetermined amounts of PVK, TSB 20 and KF 96 were added and the mixture was dispersed again to form a standard recipe composition. Then, 0.1 g, 0.25 g, 0.5 g or 1.0 g of acenaphthylene, 0.25 g, 0.5 g or 1.0 g of pyrene or 0.25 g, 0.5 g or 1.0 g of phenanthrene was added to the standard recipe composition and the mixture was dissolved by ultrasonic disperser. Thus, 10 kinds of compositions were prepared. Each composition was uniformly coated on an aluminum substrate having a thickness of 80μ, the surface of which had been subjected to the anodic oxidation treatment, by a coating wire bar No. 30, and the coated composition was dried at 100° C. for 20 minutes. The so obtained samples were allowed to stand in the dark place for 24 hours and then used for measurements of various properties.

Charging characteristics were measured by using a copying paper test apparatus, Model SP 428 supplied by Kawaguchi Denki Seisakusho, while a voltage of 6 KV was applied. Exposure was carried out at an illuminance of 40 luxes by using a tungsten lamp. The initial voltage was expressed by the surface potential just before the exposure, and the half-value exposure quantity was expressed by the product of the time (seconds) required for the initial voltage to be reduced to ½ and the illuminance (luxes). The surface strength test was carried out by stretching the coated sample on a measurement terminal (10 mm × 10 mm), placing a high quality paper on a surface having a good smoothness, superposing the sample on the high quality paper so that the coated surface of the sample was brought into contact with the surface of the high quality paper and reciprocatively moving the sample along 10 cm in the same area 20 times under a load of 2 Kg. The surface strength was evaluated based on the state of the sample surface and the degree of contamination of the surface of the high quality paper. The mark "X" indicates that the coating layer of the sample was entirely peeled and the aluminum substrate was exposed, the mark "Δ" indicates that the coating layer of the sample was partially peeled and the aluminum substrate was partially exposed, the mark " indicates that the coating layer of the sample was partially peeled but the aluminum substrate was not exposed, and the mark " " indicates that the coating layer of the sample was hardly changed. The adhesion test was carried out by applying a pressure-sensitive adhesive cellophane tape to the photosensitive surface and violently peeling off the adhesive tape. The obtained results are shown in Table 1.

TABLE 1

| Additive (g per g of PVK) | | Polarity: Negative Charging (−) Initial Voltage (V) | Negative Charging (−) Half-Value Exposure Quantity (Lux · Sec) | Positive Charging (+) Initial Voltage (V) | Positive Charging (+) Half-Value Exposure Quantity (Lux · Sec) | Surface Friction Strength |
|---|---|---|---|---|---|---|
| standard recipe | | 293 | 21.6 | 238 | 38.0 | × |
| acenaphthylene | (0.1) | 285 | 22.4 | 220 | 33.2 | Δ |
| " | (0.25) | 284 | 22.8 | 218 | 30.8 | ○ |
| " | (0.5) | 292 | 24.0 | 200 | 29.6 | ○ |
| " | (1.0) | 270 | 21.6 | 190 | 28.0 | ○ |
| pyrene | (0.25) | 273 | 21.8 | 224 | 26.3 | ○ |
| " | (0.5) | 287 | 21.6 | 247 | 26.5 | ◎ |
| " | (1.0) | 333 | 21.7 | 218 | 26.3 | ◎ |
| Phenanthrene | (0.25) | 284 | 18.9 | 210 | 30.4 | Δ |
| " | (0.5) | 275 | 18.5 | 200 | 30.0 | ○ |
| " | (1.0) | 263 | 18.0 | 238 | 30.0 | ○ |

From the results shown in Table 1, it is seen that by incorporation of the fused aromatic hydrocarbon, the sensitivity is increased at the positive charging over the standard recipe composition (free of the fused aromatic hydrocarbon) and that in case of the standard recipe, at the surface strength test and adhesion test the coating is peeled and the aluminum substrate is exposed on the entire surface, but if the fused aromatic hydrocarbon is incorporated in an amount of at least 0.25 g per g of PVK (as solids), peeling does not occur and good results are obtained.

EXAMPLE 2

Standard Recipe (Free of Fused Aromatic Hydrocarbon)

| | |
|---|---|
| PVK (10% solution in THF) | 10 g |
| 2,4,7-Trinitrofluorenone | 0.1 g |
| THF | 4.0 g |
| KF 96 (silicone oil having viscosity of 10 c.s., manufactured and supplied by Shinetsu Kagaku Kogyo K.K.) | 10 mg |

A composition of the above standard recipe was dispersed for about 20 seconds by an ultrasonic disperser, and 0.5 g of phenanthrene, pyrene or acenaphthylene was added as the fused aromatic hydrocarbon to the standard recipe composition and the mixture was dissolved by an ultransonic disperser. Thus, three kinds of coating compositions were prepared. Each composition was uniformly coated on an aluminum substrate having a thickness of 80μ, the surface of which had been subjected to the anodic oxidation treatment, by a coating wire bar No. 28, and the coating composition was dried at 100° C. for 20 minutes. The so obtained samples were allowed to stand in the dark place for 24 hours and used as measurement samples. The charging characteristics and surface strength were tested in the same manner as described in Example 1. The obtained results are shown in Table 2.

TABLE 2

| Additive (g per g of PVK) | Polarity: Negative Charging (−) Initial Voltage (V) | Negative Charging (−) Half-Value Exposure Quantity (lux · Sec) | Positive Charging (+) Initial Voltage (V) | Positive Charging (+) Half-Value Exposure Quantity (lux · Sec) | Surface Friction Strength |
|---|---|---|---|---|---|
| standard recipe | 550 | 26.0 | 480 | 28.0 | × |
| acenaphthylene | 675 | 24.0 | 500 | 28.0 | ○ |
| phenanthrene | 600 | 26.0 | 490 | 29.0 | ○ |
| pyrene | 750 | 25.0 | 620 | 26.0 | |

From the results shown in Table 2, it is seen that by incorporation of a fused aromatic hydrocarbon such as acenaphthylene, phenanthrene or pyrene, the initial voltage is increased and the surface frictional strength is highly improved over the standard recipe (free of the fused aromatic hydrocarbon) without any substantial influence on the photosensitivity.

EXAMPLE 3

Standard Recipe (Free of Fused Aromatic Hydrocarbon)

| | |
|---|---|
| PVK (10% solution in THF) | 10 g |
| Paliogen Orange 2640 (Pigment Orange 51 manufactured and supplied by BASF AG.) | 0.75 g |
| Tetrahydrofuran (THF) | 12 g |
| Polyester Adhesive 49000 (20% 0.5 polyester solution in THF, manufactured and supplied by Du Pont Co.) | g |
| KF 96 (silicone oil having viscosity of 10 c.s., manufactured and supplied by Shinetsu Kagaku Kogyo K. K.) | 10 mg |

In the above standard recipe, Paliogen Orange 2640 and THF were dispersed by an ultrasonic disperser for about 1 minute, and predetermined amounts of PVK, Polyester Adhesive 49000 and KF 96 were added and the mixture was dispersed again. Then, 1 g, 1.5 g, 2 g or 2.5 g of phenanthrene or 1 g, 1.5 g, 2 g or 2.5 g of acenaphthylene was dissolved in the above standard recipe composition by an ultrasonic disperser. Thus, 8 kinds of coating compositions were prepared. Each composition was uniformly coated on an aluminum substrate having a thickness of 80μ, the surface of which had been subjected to the anodic oxidation treatment, by a coating wire bar No. 28, and the coated composition was dried at 100° C. for 20 minutes. The so prepared samples were allowed to stand in the dark place for 24 hours and were used as measurement samples.

The charging characteristics and surface strength were tested in the same manner as described in Example 1. The obtained results are shown in Table 3.

TABLE 3

| Additive (g per g of PVK) | Polarity: Negative Charging (−) initial Voltage (V) | Negative Charging (−) Half-Value Exposure Quantity (Lux · Sec) | Positive Charging (+) initial Voltage (V) | Positive Charging (+) Half-Value Exposure Quantity (Lux · Sec) | Surface Friction Strength |
|---|---|---|---|---|---|
| standard recipe | 300 | 44.4 | 237 | 57.2 | △ |
| phenanthrene (1.0) | 330 | 34.0 | 291 | 50.0 | ○ |
| " (1.5) | 308 | 32.8 | 282 | 44.8 | ○ |
| " (2.0) | 295 | 42.0 | 284 | 44.0 | ◎ |
| " (2.5) | 295 | 42.0 | 273 | 42.8 | ◎ |
| acenaphthylene (1.0) | 338 | 32.0 | 288 | 48.8 | ○ |
| " (1.5) | 320 | 30.8 | 273 | 47.2 | ○ |
| " (2.0) | 297 | 35.2 | 276 | 49.6 | ○ |
| " (2.5) | 308 | 36.0 | 273 | 48.8 | ◎ |

From the results shown in Table 4, it will readily be understood that by incorporated of the fused aromatic hydrocarbon (acenaphthylene or phenanthrene), no substantial reduction of the initial voltage is caused as compared with the standard recipe composition, and that the photosensitivity is increased by incorporation of the fused aromatic compound, and at the negative charging the sensitization is highest when acenaphthylene is added in an amount of 1.5 g per g of PVK and at the positive charging the sensitization is highest when phenanthrene is incorporated in an amount of 2.5 g per g of PVK. Moreover, it is seen that the surface strength is increased with increase of the amount incorporated of the fused aromatic hydrocarbon.

EXAMPLE 4

Standard Recipe (Free of Fused Aromatic Hydrocarbon)

| | |
|---|---|
| PVK (10% solution in THF) | 10 g |
| Heliogen Blue 7800 (phthalocyanine pigment manufactured and supplied by BASF AG.) | 0.25 g |
| THF | 25 g |
| Polyester Adhesive 49000 (20% polyester solution in THF, manufactured and supplied by Du Pont Co.) | 0.5 g |
| KF 96 (silicone oil having viscosity of 10 c.s., manufactured and supplied by Shinetsu Kagaku | 10 mg |

-continued

| |
|---|
| Kogyo K. K.) |

In the above standard recipe, Heliogen Blue 7800 was dispersed in THF for about 1 minute by an ultrasonic disperser, and predetermined amounts of PVK, Polyester Adhesive 49000 and KF 96 were added to the dispersion and the mixture was dispersed again. Then, 0.3 g of phenanthrene, acenaphthylene or pyrene was added as the fused aromatic hydrocarbon and dissolved in the standard recipe composition by an ultrasonic disperser. The so prepared composition was uniformly coated on an aluminum substrate having a thickness of 80μ, the surface of which had been subjected to the anodic oxidation treatment, by a coating wire bar No. 28, and the coated composition was dried at 100° C. for 20 minutes. The obtained sample was allowed to stand in the dark place for 24 hours and was used as the measurement sample.

The charging characteristics were measured in the same manner as described in Example 1. The surface strength was tested in the same manner as in Example 1 except that the sample was reciprocatively moved 10 times under a load of 1 Kg. The obtained results are shown in Table 4.

TABLE 4

| Additive (g per g of PVK) | Polarity: Negative Charging (−) Initial Voltage (V) | Negative Charging (−) Half-Value Exposure Quantity (Lux · Sec) | Positive Charging (+) Initial Voltage (V) | Positive Charging (+) Half-Value Exposure Quantity (Lux · Sec) | Surface Friction Strength |
|---|---|---|---|---|---|
| standard recipe | 228 | 26.0 | 190 | 16.0 | × |
| phenanthrene | 275 | 27.0 | 213 | 16.0 | ○ |
| acenaphthylene | 285 | 28.0 | 237 | 16.0 | ○ |
| pyrene | 375 | 27.0 | 338 | 16.0 | ○ |

From the results shown in Table 4, it is seen that by incorporation of the fused aromatic hydrocarbon, the initial voltage is increased over the standard recipe composition (free of the fused aromatic hydrocarbon) and the surface frictional strength is improved with reduction of the sensitivity.

EXAMPLE 5

Standard Recipe (Free of Fused Aromatic Hydrocarbon)

| | |
|---|---|
| PVK (10% solution in THF) | 10 g |
| 950 Red (Pigment Red 41 manufactured and supplied by Dainichi Seika K.K.) | 0.5 g |
| THF | 20 g |
| Vylon 200 (10% polyester resin solution in THF, manufactured and supplied by Toyobo K.K.) | 1 g |
| KF 96 (silicone oil having viscosity of 10 c.s., manufactured and supplied by Shinetsu Kagaku Kogyo K.K.) | 10 mg |

In the standard recipe, 950 RED was dispersed in THF for about 1 minute by an ultrasonic disperser, and predetermined amounts of PVK, Vylon 200 and KF 96 were added to the dispersion and the mixture was dispersed again to obtain a standard recipe composition. Then, 1.0 g of phenanthrene, pyrene or acenaphthylene was added as the fused aromatic hydrocarbon to the standard recipe composition and dissolved by an ultrasonic disperser. The so formed composition was uniformly coated on an aluminum substrate having a thickness of 80μ, the surface of which had been subjected to the anodic oxidation treatment, by a coating wire bar No. 24, and the coated composition was dried at 100° C. for 20 minutes. The so obtained sample was allowed to stand in the dark place for 24 hours and was used as the measurement sample. The charging characteristics were tested in the same manner as described in Example 1. The obtained results are shown in Table 5.

TABLE 5

| Additive (g per g of PVK) | Polarity: Negative Charging (−) Initial Voltage (V) | Negative Charging (−) Half-Value Exposure Quantity (Lux · Sec) | Positive Charging (+) Initial Voltage (V) | Positive Charging (+) Half-Value Exposure Quantity (Lux · Sec) |
|---|---|---|---|---|
| standard recipe | 410 | 60 | 380 | 28 |
| acenaphthylene | 420 | 48 | 350 | 28 |
| pyrene | 430 | 52 | 360 | 28 |
| phenanthrene | 430 | 48 | 360 | 28 |

From the results shown in Table 5, it is seen that by incorporation of acenaphthylene, pyrene or phenanthrene as the fused aromatic hydrocarbon, the sensitivity at the negative charging is remarkably increased over the standard recipe composition without reduction of the photosensitivity at the positive charging, and that also the initial voltage is increased to some extent by incorporation of the fused aromatic hydrocarbon.

What we claim is:

1. A process for the production of a photosensitive plate for electrophotography which comprises forming a coating composition comprising (a) polyvinyl carbazole and (b) 0.05 to 3 parts by weight, per part by weight of polyvinyl carbazole, of a fused polycyclic aromatic hydrocarbon selected from the group consisting of phenanthrene, acenaphthylene and pyrene dissolved in an organic solvent and further comprising (c) a photoconductive organic pigment dispersed therein, coating the composition on the surface of a conductive substrate and drying the coated composition to form a photosensitive layer having a thickness of 1 to 100 microns.

2. The process of claim 1 wherein the amount of the aromatic hydrocarbon is 0.1 to 2 parts by weight per part by weight of polyvinyl carbazole.

3. The process of claim 2 wherein the photoconductive organic pigment is present in an amount of 5 to 300 parts by weight per 100 parts by weight of polyvinyl carbazole.

4. The process of claim 1 wherein the aromatic hydrocarbon is phenanthrene.

5. The process of claim 1 wherein the aromatic hydrocarbon is acenaphthylene.

6. The process of claim 1 wherein the aromatic hydrocarbon is pyrene.

7. A process for the production of a photosensitive plate for electrophotography which comprises forming a coating composition comprising (a) polyvinyl carbazole and (b) 0.05 to 3 parts by weight, per part by weight of polyvinyl carbazole, of a fused polycyclic aromatic hydrocarbon selected from the group consisting of phenanthrene, acenaphthylene and pyrene dissolved in an organic solvent and further comprising (c') an electron-receptive compound dissolved therein, coating the composition on the surface of a conductive substrate and drying the coated composition to form a photosensitive layer having a thickness of 1 to 100 microns.

8. The process of claim 7 wherein the amount of the aromatic hydrocarbon is 0.1 to 2 parts by weight per part by weight of polyvinyl carbazole.

9. The process of claim 8 wherein the electron-receptive compound is present in an amount of 1 to 200 parts by weight per 100 parts by weight of polyvinyl carbazole.

10. The process of claim 7 wherein the aromatic hydrocarbon is phenanthrene.

11. The process of claim 7 wherein the aromatic hydrocarbon is acenaphthylene.

12. The process of claim 7 wherein the aromatic hydrocarbon is pyrene.

* * * * *

UNITED STATES PATENT AND TRADEMARK OFFICE

CERTIFICATE OF CORRECTION

PATENT NO. : 4,477,551

DATED : October 16, 1984

INVENTOR(S) : AKIRA FUSHIDA, ET AL.

It is certified that error appears in the above-identified patent and that said Letters Patent is hereby corrected as shown below: Title page:

[73] Assignee: Delete "MHA" and insert -- MITA --.

Signed and Sealed this

*Sixteenth* Day of *April 1985*

[SEAL]

*Attest:*

DONALD J. QUIGG

*Attesting Officer* *Acting Commissioner of Patents and Trademarks*